US009909549B2

(12) United States Patent
Mueller

(10) Patent No.: US 9,909,549 B2
(45) Date of Patent: Mar. 6, 2018

(54) DUCTED FUEL INJECTION

(71) Applicant: National Technology & Engineering Solutions of Sandia, LLC, Albuquerque, NM (US)

(72) Inventor: Charles J. Mueller, Livermore, CA (US)

(73) Assignee: National Technology & Engineering Solutions of Sandia, LLC, Albuquerque, NM (US)

( * ) Notice: Subject to any disclaimer, the term of this patent is extended or adjusted under 35 U.S.C. 154(b) by 168 days.

(21) Appl. No.: 14/789,782

(22) Filed: Jul. 1, 2015

(65) Prior Publication Data

US 2016/0097360 A1 Apr. 7, 2016

Related U.S. Application Data

(60) Provisional application No. 62/058,613, filed on Oct. 1, 2014.

(51) Int. Cl.
*F02M 61/18* (2006.01)
*F02M 61/14* (2006.01)

(52) U.S. Cl.
CPC ..... *F02M 61/1813* (2013.01); *F02M 61/14* (2013.01); *F02M 61/1806* (2013.01)

(58) Field of Classification Search
CPC ..... F02M 61/1813; F02M 61/14
USPC ..... 123/294, 298; 239/533.12
See application file for complete search history.

(56) References Cited

U.S. PATENT DOCUMENTS 1,260,408 A * 3/1918 Leissner ..... F02B 3/06 123/251
2,223,590 A 12/1940 Alden
2,295,081 A 9/1942 Harvath
2,583,726 A * 1/1952 Chalom ..... B24C 5/04 239/427
3,035,780 A * 5/1962 Peras ..... F02M 61/06 239/453
3,425,399 A 2/1969 Ward et al.
(Continued)

FOREIGN PATENT DOCUMENTS

DE 894338 10/1953
FR 2880915 7/2006
(Continued)

*Primary Examiner* — Stephen K Cronin
*Assistant Examiner* — Kody Kight
(74) *Attorney, Agent, or Firm* — Medley, Behrens & Lewis, LLC

(57) ABSTRACT

Various technologies presented herein relate to enhancing mixing inside a combustion chamber to form one or more locally premixed mixtures comprising fuel and charge-gas with low peak fuel to charge-gas ratios to enable minimal, or no, generation of soot and other undesired emissions during ignition and subsequent combustion of the locally premixed mixtures. To enable sufficient mixing of the fuel and charge-gas, a jet of fuel can be directed to pass through a bore of a duct causing charge-gas to be drawn into the bore creating turbulence to mix the fuel and the drawn charge-gas. The duct can be located proximate to an opening in a tip of a fuel injector. The duct can comprise of one or more holes along its length to enable charge-gas to be drawn into the bore, and further, the duct can cool the fuel and/or charge-gas prior to combustion.

16 Claims, 9 Drawing Sheets

(56) References Cited

U.S. PATENT DOCUMENTS

| | | | | |
|---|---|---|---|---|
| 3,644,076 | A * | 2/1972 | Bagge | F23D 11/36 239/132.3 |
| 3,787,168 | A | 1/1974 | Koppang et al. | |
| 3,844,707 | A | 10/1974 | Wormser | |
| 4,020,801 | A | 5/1977 | Jarnuszkiewicz | |
| 4,067,496 | A | 1/1978 | Martin | |
| 4,245,589 | A | 1/1981 | Ryan | |
| 4,480,613 | A | 11/1984 | Siewert | |
| 4,548,172 | A * | 10/1985 | Bailey | F02B 1/02 123/297 |
| 4,974,559 | A | 12/1990 | Nagaoka | |
| 5,235,805 | A | 8/1993 | Barbier et al. | |
| 5,294,056 | A * | 3/1994 | Buchholz | F02M 67/02 239/408 |
| 5,388,985 | A | 2/1995 | Musil et al. | |
| 5,498,153 | A | 3/1996 | Jones | |
| 5,573,396 | A | 11/1996 | Swanson | |
| 7,051,956 | B2 | 5/2006 | Upatnieks | |
| 7,402,039 | B1 | 7/2008 | McElroy | |
| 7,661,401 | B2 | 2/2010 | Anezaki et al. | |
| 8,142,169 | B2 | 3/2012 | Whaling et al. | |
| 8,864,491 | B1 | 10/2014 | Pfefferie et al. | |
| 8,967,129 | B2 | 3/2015 | Mueller | |
| 2002/0041836 | A1 | 4/2002 | Komai et al. | |
| 2004/0211389 | A1 | 10/2004 | Delisle | |
| 2008/0011887 | A1 | 1/2008 | Parish | |
| 2008/0201063 | A1 | 8/2008 | Reuss et al. | |
| 2009/0020633 | A1* | 1/2009 | Limmer | F02M 61/1806 239/533.12 |
| 2009/0050717 | A1* | 2/2009 | Takase | F02M 61/1886 239/533.12 |
| 2009/0255998 | A1* | 10/2009 | Das | F02M 61/162 239/5 |
| 2011/0067671 | A1 | 3/2011 | Laimboeck | |
| 2012/0186555 | A1 | 7/2012 | Mueller | |
| 2014/0075949 | A1 | 3/2014 | Prociw | |
| 2016/0298531 | A1 | 10/2016 | Anders et al. | |
| 2016/0298583 | A1 | 10/2016 | Anders et al. | |

FOREIGN PATENT DOCUMENTS

| | | |
|---|---|---|
| JP | 1976042311 | 3/1976 |
| JP | 3286124 | 12/1991 |
| JP | 5086864 | 4/1993 |
| JP | 5272338 | 10/1993 |
| JP | 5296045 | 11/1993 |
| JP | 2002276373 | 9/2002 |
| JP | 2004308449 | 11/2004 |

* cited by examiner

DUCTED FUEL INJECTION

RELATED APPLICATION

This application claims priority to U.S. Provisional Patent Application No. 62/058,613, filed on Oct. 1, 2014, entitled "DUCTED FUEL INJECTION", the entirety of which is incorporated herein by reference.

STATEMENT OF GOVERNMENTAL INTEREST

This invention was developed under contract DE-AC04-94AL85000 between Sandia Corporation and the U.S. Department of Energy. The U.S. Government has certain rights in this invention.

BACKGROUND

Most modern engines are direct injection engines, such that each combustion cylinder of the engine includes a dedicated fuel injector configured to inject fuel directly into a combustion chamber. While direct injection engines represent an improvement in engine technology over past designs (e.g., carburetors) with regard to increased engine efficiency and reduced emissions, direct injection engines can produce relatively high levels of certain undesired emissions.

Engine emissions can include soot, which results from combustion of a fuel-rich and oxygen-lean fuel mixture. Soot comprises small carbon particles created by the fuel-rich regions of diffusion flames commonly created in a combustion chamber of an engine, which may be operating at medium to high load. Soot is an environmental hazard, an emission regulated by the Environmental Protection Agency (EPA) in the United States of America, and the second most important climate-forcing species (carbon dioxide being the most important). Currently, soot is removed from the exhaust of diesel engines by large and expensive particulate filters in the exhaust system. Other post-combustion treatments may also have to be utilized, such as $NO_x$ selective catalytic reduction, a $NO_x$ trap, oxidation catalyst, etc. These after-treatment systems have to be maintained to enable continued and effective reduction of soot/particulates and other undesired emissions, and accordingly add further cost to a combustion system both in terms of initial equipment cost and subsequent maintenance.

A focus of combustion technologies is burning fuel in leaner mixtures, because such mixtures tend to produce less soot, $NO_x$, and potentially other regulated emissions such as hydrocarbons (HC) and carbon monoxide (CO). One such combustion strategy is Leaner Lifted-Flame Combustion (LLFC). LLFC is a combustion strategy that does not produce soot because combustion occurs at equivalence ratios less than or equal to approximately two. The equivalence ratio is the actual ratio of fuel to oxidizer divided by the stoichiometric ratio of fuel to oxidizer. LLFC can be achieved by enhanced local mixing of fuel with the charge-gas (i.e., air with or without additional gas-phase compounds) in the combustion chamber.

SUMMARY

The following is a brief summary of subject matter that is described in greater detail herein. This summary is not intended to be limiting as to the scope of the claims.

Described herein are various technologies designed to enhance local mixing rates inside a combustion chamber, relative to mixing produced in a conventional combustion chamber configuration/arrangement. The enhanced mixing rates are used to form one or more locally premixed mixtures comprising fuel and charge-gas, featuring lower peak fuel to charge-gas ratios, with the objective of enabling minimal, or zero, generation of soot in the combustion chamber during ignition and subsequent combustion of the locally premixed mixtures. To enable mixing of the fuel and the charge-gas to produce a locally premixed mixture with a lower peak fuel to charge-gas ratio, a jet of fuel can be directed such that it passes through a bore of a duct (e.g., down a tube, a hollow cylindroid), with passage of the fuel causing charge-gas to be drawn into the bore such that turbulence is created within the bore to cause enhanced mixing of the fuel and the drawn charge-gas. A charge-gas inside the combustion chamber can comprise of air with or without additional gas-phase compounds.

Combustion of the locally premixed mixture(s) can occur within a combustion chamber, wherein the fuel can be any suitable flammable or combustible liquid or vapor. For example, the combustion chamber can be formed as a function of various surfaces comprising a wall of a cylinder bore (e.g., formed in an engine block), a flame deck surface of a cylinder head, and a piston crown of a piston that reciprocates within the cylinder bore. A fuel injector can be mounted in the cylinder head, wherein fuel is injected into the combustion chamber via at least one opening in a tip of the fuel injector. For each opening in the fuel injector tip, a duct can be aligned therewith to enable fuel injected by the fuel injector to pass through the bore of the duct. Charge-gas is drawn into the bore of the duct as a result of the low pressures locally created by the high velocity jet of fuel flowing through the bore. This charge-gas mixes rapidly with the fuel due to intense turbulence created by the large velocity gradients between the duct wall and the centerline of the fuel jet, resulting in the formation of a locally premixed mixture with a lower peak fuel to charge-gas ratio exiting the duct to undergo subsequent ignition and combustion in the combustion chamber.

In an embodiment, the duct can have a number of holes or slots formed along its length to further enable charge-gas to be drawn into the bore of the duct during passage of the fuel along the bore.

In another embodiment, the duct can be formed from a tube, wherein the walls of the tube are parallel to each other (e.g., a hollow cylinder), hence a diameter of the bore at the first end of the duct (e.g., an inlet) is the same as the diameter of the bore at the second end of the duct (e.g., an outlet). In another embodiment, the walls of the tube can be non-parallel such that the diameter of the bore at the first end of the duct is different from the diameter of the bore at the second end of the duct.

The duct(s) can be formed from any material suitable for application in a combustion chamber, e.g., a metallic-containing material (e.g., steel, INCONEL, HASTELLOY, . . . ), a ceramic-containing material, etc.

In a further embodiment, the duct(s) can be attached to the fuel injector prior to insertion of the fuel injector into the combustion chamber, with an assembly comprising the fuel injector and the duct(s) being located to form a portion of the combustion chamber. In another embodiment, the fuel injector can be located in the combustion chamber and the duct(s) subsequently attached to the fuel injector.

During operation of the engine, a temperature inside the bore of the duct may be less than an ambient temperature inside the combustion chamber such that the ignition delay of the mixture is increased, and mixing of the fuel and charge-gas prior to autoignition is further improved compared with direct injection of the fuel into the combustion chamber.

The above summary presents a simplified summary in order to provide a basic understanding of some aspects of the systems and/or methods discussed herein. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

DETAILED DESCRIPTION

Figure 1:
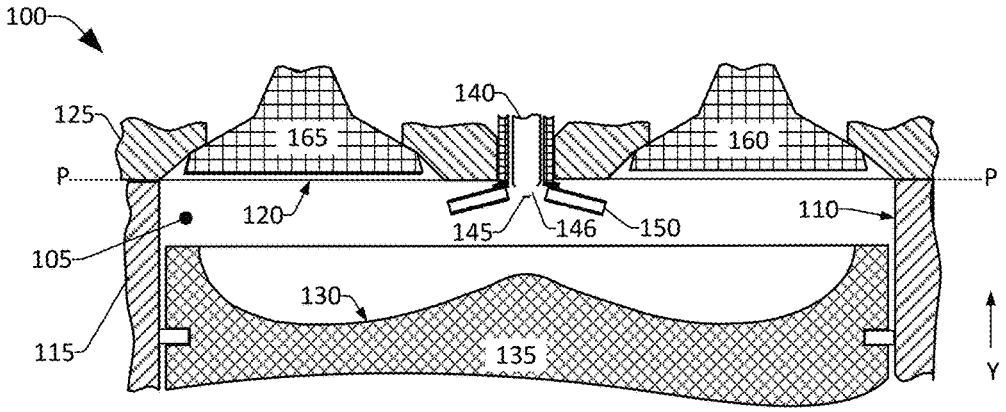
FIG. 1 is a sectional view of an exemplary combustion chamber apparatus.

Various technologies are presented herein pertaining to utilizing one or more ducts to create locally premixed fuel and charge-gas mixtures with lower peak fuel to charge-gas ratios prior to combustion, with a primary objective being to minimize and/or preclude the generation of soot (or other undesired particulates/emissions). Like reference numerals are used to refer to like elements of the technologies throughout. In the following description, for purposes of explanation, numerous specific details are set forth in order to provide a thorough understanding of one or more aspects. It may be evident, however, that such aspect(s) may be practiced without these specific details. In other instances, well-known structures and devices are shown in block diagram form in order to facilitate describing one or more aspects.

Further, the term "or" is intended to mean an inclusive "or" rather than an exclusive "or". That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form. Additionally, as used herein, the term "exemplary" is intended to mean serving as an illustration or example of something, and is not intended to indicate a preference.

Figure 2:
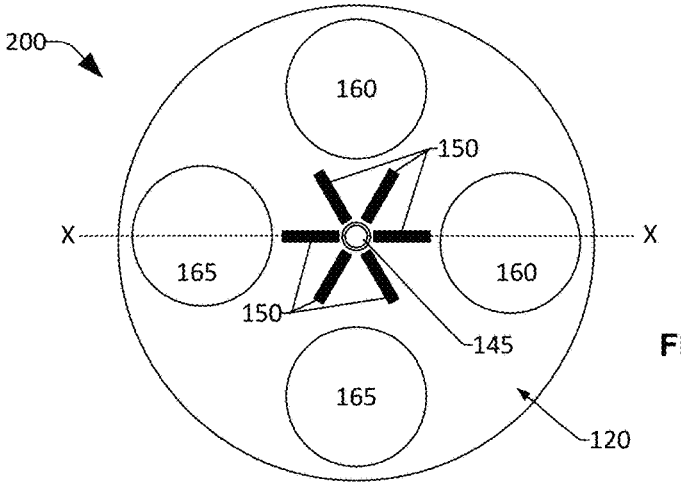
FIG. 2 is a schematic illustrating a flame deck, valves, fuel injector and ducts forming an exemplary combustion chamber apparatus.
Figure 3:
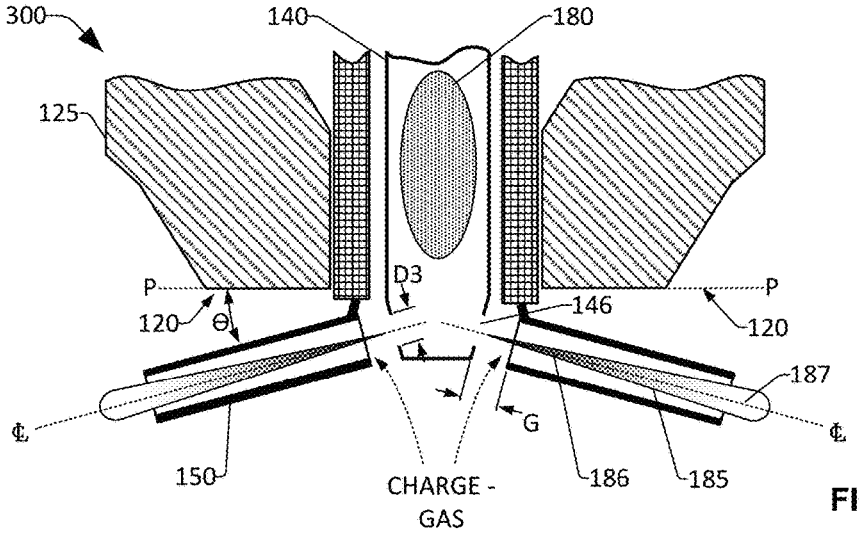
FIG. 3 is a close-up view of an exemplary combustion chamber apparatus comprising a fuel injector and an arrangement of ducts.

FIGS. 1, 2, and 3 illustrate an exemplary configuration(s) for a ducted fuel injection system. FIG. 1 is a sectional view through a combustion chamber assembly 100, wherein the sectional view is along X-X of FIG. 2. FIG. 2 illustrates configuration 200 which is a planar view of the combustion chamber assembly 100 in direction Y of FIG. 1. FIG. 3 presents configuration 300 which is an enlarged view of the fuel injection assembly illustrated in FIGS. 1 and 2.

FIGS. 1-3 collectively illustrate a plurality of common components which combine to form a combustion chamber 105. In an embodiment, the combustion chamber 105 has a generally cylindrical shape that is defined within a cylinder bore 110 formed (e.g., machined) within a crankcase or engine block 115 of an engine (not shown in its entirety). The combustion chamber 105 is further defined at one end (a first end) by a flame deck surface 120 of a cylinder head 125, and at another end (a second end) by a piston crown 130 of a piston 135 that can reciprocate within the bore 110. A fuel injector 140 is mounted in the cylinder head 125. The injector 140 has a tip 145 that protrudes into the combustion chamber 105 through the flame deck surface 120 such that it can directly inject fuel into the combustion chamber 105. The injector tip 145 can include a number of openings 146 (orifices) through which fuel is injected into the combustion chamber 105. Each opening 146 can be of a particular shape, e.g., a circular opening, and further, each opening 146 can have a particular opening diameter, D3.

Further, the combustion chamber 105 has located therein one or more ducts 150 which can be utilized to direct fuel injected in the combustion chamber 105 via an opening 146 of the injector 140 (as further described below). Per conventional operation of a combustion engine, an inlet valve(s) 160 is utilized to enable inlet of charge-gas into the combustion chamber 105, and an exhaust valve(s) 165 to enable exhausting of any combustion products (e.g., gases, soot, etc.) formed in the combustion chamber 105 as a function of a combustion process occurring therein. A charge-gas inside the combustion chamber 105 can comprise of air with or without additional gas-phase compounds.

Figure 4:
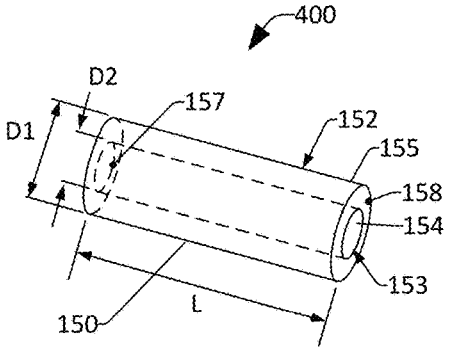
FIG. 4 is a schematic of a duct having a cylindrical configuration.

FIG. 2 illustrates the plurality of inlet valves 160 and the plurality of exhaust valves 165 which can be incorporated into the combustion chamber 105. Also, as shown in FIG. 2, one or more ducts 150 can be arranged around the tip 145, wherein, per FIG. 4, configuration 400, the duct 150 can be a tube or hollow cylindroid, comprising an external wall 152 having an external diameter D1, and an internal bore 153 passing through the length of the duct 150, wherein the internal bore 153 has a diameter D2. As shown in FIG. 4, the duct 150 can be cylindrically formed such that an inner surface 154 of the external wall 152 and an outer surface 155 of the external wall 152 are parallel, and accordingly a first opening 157 at a first end of the duct 150 has the same diameter as a second opening 158 at a second end of the duct 150, e.g., the diameter of the first opening 157 (e.g., an inlet)=D2=the diameter of the second opening 158 (e.g., an outlet). The first end of the duct 150 can be located nearest to (proximal, adjacent to, abut) the opening 146, while the second end of the duct 150 is located distal to the opening 146 relative to the position of the first end of the duct 150. In an embodiment, as further described herein, the thickness of the external wall 152 can alter along the length of the duct 150, such that while the outer surface 155 of the external wall 152 is cylindrical, the inner surface 154 can be tapered and/or have a conical shape. In a further embodiment, the length L of the duct 150 can be of any desired length. For example, the duct 150 can have a length L of between about 30 to about 300 times the nominal diameter D3 of the opening 146, for example, about 30×D3 to about 300×D3.

Turning to FIG. 3, as previously mentioned, the tip 145 can include a plurality of openings 146 to enable passage of fuel 180 therethrough (e.g., fuel injection). From an initial volume of fuel 180 flowing through the injector 140, a plurality of jets of fuel 185 can be formed in accordance with the number and size of openings 146 located at the tip 145, as the initial fuel 180 passes through the respective openings 146. A direction of injection of the injected fuel 185 can be depicted per the centerline(s), L, illustrated on FIG. 3. Hence, a duct 150 can be co-aligned (e.g., co-axially) with the centerline of the jet of fuel 185, such that the jet of fuel 185 exits from an opening 146 and passes through the bore 153 of the duct 150. Per FIGS. 3 and 4, a first (proximal) end 157 of the duct 150 can be positioned proximate to a respective opening 146, wherein the first end 157 can be positioned such that a gap, G, exists between the first end of the duct 150 and the opening 146. A second (distal) end 158 of the duct 150 can be located in the combustion chamber 105 such that the duct 150 extends from the tip 145 and into the combustion chamber 105.

As previously mentioned, in a situation where a fuel-rich mixture of fuel and charge-gas undergoes combustion, soot can be generated, which is undesirable. Hence, it is desired to have a fuel/charge-gas mixture having equivalence ratios less than or equal to approximately two. As the respective jet(s) of fuel 185 travels through the bore 153 of the respective duct 150, a pressure differential is generated inside of the duct 150 such that charge-gas in the combustion chamber 105 is also drawn into the duct 150. The charge-gas mixes rapidly with the fuel 185 due to intense turbulence created by the high velocity gradients between the duct bore 153 (at which the fluid velocity is zero) and the centerline of the fuel jet 185 (at which the fluid velocity is large). The turbulent conditions can enhance the rate of mixing between the jet of fuel 185 and the drawn charge-gas, wherein the degree of mixing of the fuel 185 and charge-gas in the bore 153 can be greater than a degree of mixing that would occur in a conventional configuration wherein the jet of fuel 185 was simply injected into the charge-gas filled combustion chamber 105 without passage through a duct. For the conventional configuration, the jet of fuel 185 would undergo a lesser amount of turbulent mixing with the charge-gas than is enabled by passing the jet of fuel 185 through the duct 150, per the configuration 100.

Per FIG. 3, at region 186 of the jet of fuel 185, the jet of fuel 185 comprises a high volume of fuel-rich mixture, while at the region 187 of the jet of fuel 185, the jet of fuel 185 has undergone mixing with the drawn-in charge-gas resulting in a locally more premixed mixture at region 187 compared to the fuel-rich mixture at region 186. Hence, per the configuration 100 presented in FIGS. 1-4, a high degree of mixing between the fuel 185 and the charge-gas in the duct 150 occurs, leading to a locally premixed fuel/charge-gas mixture with a lower peak fuel to charge-gas ratio, which, upon ignition and combustion of the mixture (e.g., from compression heating caused by motion of the piston 135), results in a lower quantity of soot being generated than is achieved with a conventional arrangement. A "lean-enough" mixture at the region 187 can have an equivalence ratio(s) of between 0 and 2, while a "too-rich" mixture at the region 186 is a mixture having an equivalence ratio(s) greater than 2.

In an embodiment, the diameter D2 of the bore 153 of the duct 150 can be greater than the diameter D3 of the respective opening 146 to which the first end 157 of the duct 150 is proximate. For example D2 can be about 5 times larger than D3, D2 can be about 50 times larger than D3, D2 can have a diameter that is any magnitude greater than D3, e.g., a magnitude selected in the range of about 5 times larger than D3 through to a value of 50 times larger than D3, etc.

As shown in FIG. 3, the duct(s) 150 can be aligned relative to the flame deck surface 120, with an alignment of θ° between the duct 150 and the flame deck surface 120. θ can be of any desired value, ranging from 0° (e.g., the duct 150 is aligned parallel to a plane P-P formed by the flame deck surface 120) to any desired value, wherein alignment of the duct 150 can be aligned to the centerline of travel, ℄, of the jet of fuel 185. In an embodiment, where the jet of fuel 185 exits a respective opening 146 of the fuel injector 140 in a direction aligned substantially parallel to the flame deck surface 120, plane P-P, the duct 150 can also be aligned substantially parallel to the plane P-P. A consideration for the alignment of the duct(s) 150 is prevention of interference with the reciprocating motion of the piston 135, the intake valves 160, and the exhaust valves 165, e.g., the duct(s) 150 should be aligned such that it does not come into contact with the piston crown 130, the intake valves 160, or the exhaust valves 165.

Figure 5A:
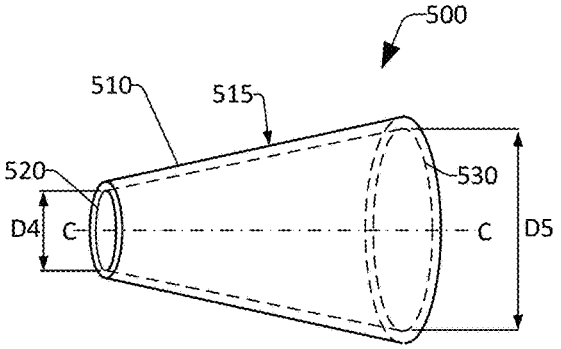
FIG. 5A is a schematic of a duct having non-parallel sides.
Figure 5B:
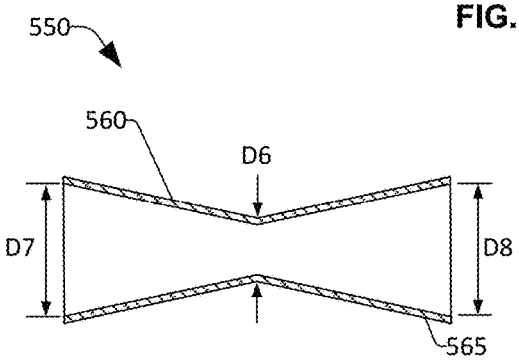
FIG. 5B is a schematic of a duct having an hourglass profile.
Figure 5C:
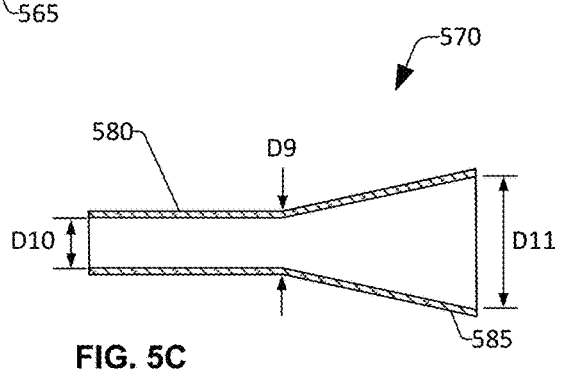
FIG. 5C is a schematic of a duct having a funnel-shaped profile.

While FIG. 4 illustrates the duct 150 as having a cylindrical form with the external surface 155 of the wall 152 being parallel to the internal surface 154 (e.g., bore 153 has a constant diameter D2 throughout), the duct 150 can be formed with any desired section. For example, in configuration 500, as illustrated in FIG. 5A, a duct 510 can be formed having an external wall 515 that is tapered such that a first opening 520 (e.g., an inlet) at a first end of the duct 500 has a diameter D4 which is different to a diameter D5 of a second opening 530 (e.g., an outlet) at a second end of the duct 510. The configuration 500 can be considered to be a hollow frustum of a right circular cone. In another configuration 550, as illustrated in FIG. 5B, a duct 560 can be formed having an external wall 565 with an "hourglass" profile, wherein a central portion can have a narrower diameter, D6, than diameters D7 (first opening) and D8 (second opening) of the respective first end and second end of the duct 560. It is to be appreciated that the diameter D7 of the first opening can have the same diameter as the diameter D8 of the second opening, or D7>D8, or D7<D8. In addition, while, for simplicity of illustration, the duct wall profiles shown in FIGS. 5A-C comprise straight lines, it is to be appreciated that these wall profiles can be produced from piecewise curved lines as well. In a further configuration 570, as illustrated in FIG. 5C, a duct 580 can be formed having an external wall 585 with a "funnel-shaped"

profile, wherein a central portion having a diameter D9 is the same as a diameter D10 at a first opening of a first end of the duct 580, while diameter D9 is less than a diameter D11 of a second opening at a second end of the duct 580. Alternatively, the duct 580 can be turned around relative to the opening 146 such that the opening having diameter D11 can be located at the opening 146, such that passage of the fuel 185 is constricted before emerging from the opening having diameter D10. While not described herein, it is to be appreciated that other duct profiles can be utilized in accordance with one or more embodiments presented herein.

Figure 6A:
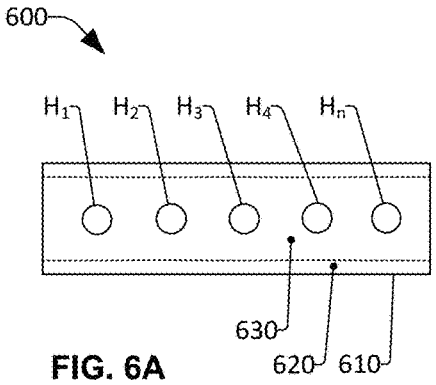
FIGS. 6A-6C illustrate a duct which includes a plurality of holes along its length.
Figure 6B:
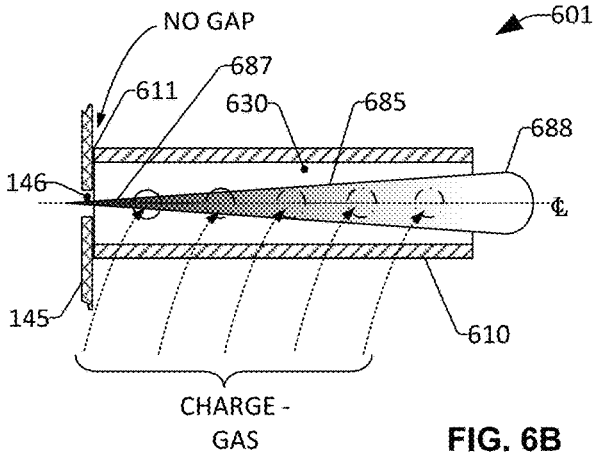
Figure 6C:
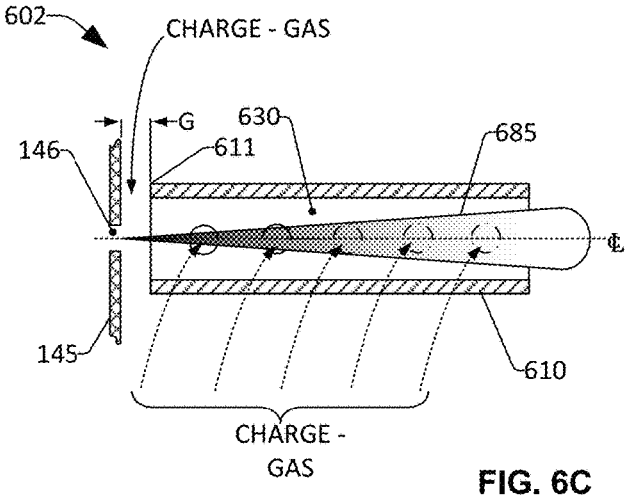

Further, as shown in FIGS. 6A-C, the tubular wall of a duct can have at least one hole(s) (perforation(s), aperture(s), opening(s), orifice(s), slot(s)) formed therein to enable ingress of charge-gas into the duct during passage of fuel through the duct. Per FIG. 6A, configuration 600, a duct 610 is illustrated, wherein the duct 610 has been fabricated with a plurality of holes, $H_1$-$H_n$, formed in a side of the duct 610 and extending through wall 620 and into internal bore 630, where n is a positive integer. It is to be appreciated that while FIG. 6A presents five holes $H_1$-$H_n$ formed into the wall 620 of the duct 610, any number of holes and respective placement can be utilized to enable drawing in charge-gas and subsequent mixing of the charge-gas with fuel passing through the duct 610. The holes $H_1$-$H_n$ can be formed with any suitable fabrication technology, e.g., conventional drilling, laser drilling, electrical discharge machining (EDM), etc.

FIG. 6B, configuration 601, is a sectional view of duct 610 illustrating a jet of fuel 685 being injected from opening 146, at injector tip 145, and through the bore 630 of the duct 610. The jet of fuel 685 initially comprises a fuel-rich region 687. However, as charge-gas is drawn into the bore 630, mixing of the fuel 685 and the charge-gas occurs (as previously described) such that region 688 comprises a locally premixed mixture with a lower peak fuel to charge-gas ratio where, during subsequent combustion, the "lean-enough" mixture undergoes combustion with minimal or no generation of soot. As shown, for configuration 601, there is no separation (e.g., no gap, G) between a first end 611 of the duct 610 and the tip 145; the first end 611 of the duct 610 abuts the opening 146. For configuration 601, while ingress of charge-gas into the bore 630 is precluded by the lack of a gap between the first end 611 of the duct 610 and the tip 145, the incorporation of holes $H_1$-$H_n$ into the duct 610 enables charge-gas to be drawn through the holes $H_1$-$H_n$ into the bore 630 to enable formation of a locally premixed jet 685. While the duct 610 is illustrated as being perpendicularly aligned (e.g., parallel to ℄) to the tip 145, the duct 610 can be positioned at any angle relative to the tip 145 (and the opening 146) to enable flow of the jet of fuel 685 through the duct 630.

FIG. 6C presents an alternative configuration 602, wherein a first end 611 of the duct 610 is located proximate to the tip 145 and the opening 146, with a gap G separating the first end 611 of the duct 610 from the tip 145. The gap G enables further charge-gas to be drawn into the duct 610 to supplement charge-gas being drawn into the bore 630 via the holes $H_1$-$H_n$. In an exemplary embodiment, the gap G may be a distance of up to about 100 times a diameter of the first end 611 of the duct 610.

Figure 7A:
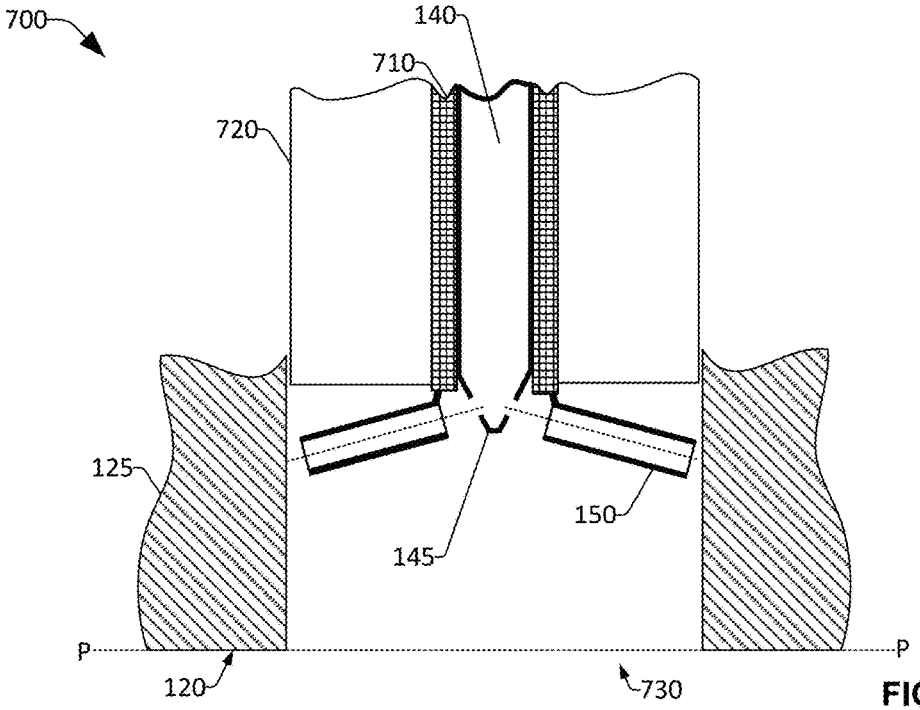
FIGS. 7A and 7B are schematics illustrating a fuel injector and duct assembly being located in a combustion chamber.
Figure 7B:
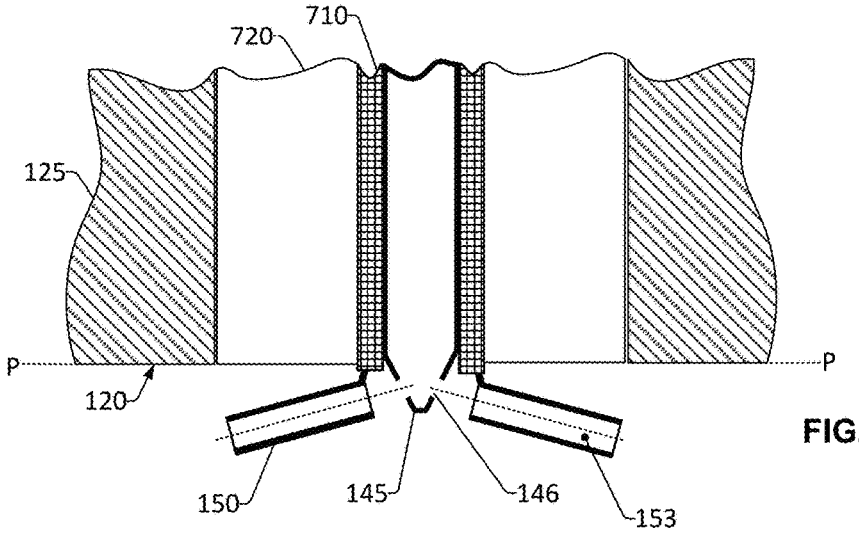

Per the various embodiments herein, a plurality of ducts can be located proximate to the injector tip 145, whereby the plurality of ducts can be attached to the injector tip 145, and the injector tip 145 and duct(s) assembly can be positioned in the cylinder head 125/flame deck surface 120 to form the combustion chamber. For example, per configuration 700 illustrated in FIGS. 7A and 7B, the duct(s) 150 can be attached to a sleeve 710 (shroud), or similar structure, which can be incorporated with the injector 140, into a support block 720. The cylinder head 125 can include an opening 730, wherein the support block 720, injector 140, sleeve 710, and duct(s) 150 are positioned relative to the flame deck surface 120 (e.g., plane P-P), per FIG. 7B, to enable location of the injector 140 and duct(s) 150 to form the combustion chamber 105, wherein the respective ducts 150 can be located with respect to the respective openings 146 of the injector 140 to enable passage of a jet of fuel (e.g., jet of fuel 185) through the bore 153.

Figure 8A:
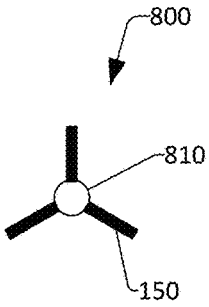
FIGS. 8A and 8B illustrate an exemplary arrangement comprising three ducts and a threaded attachment portion.
Figure 8B:
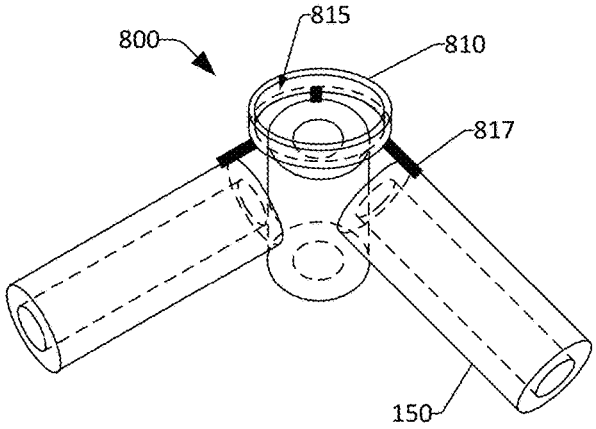
Figure 8C:
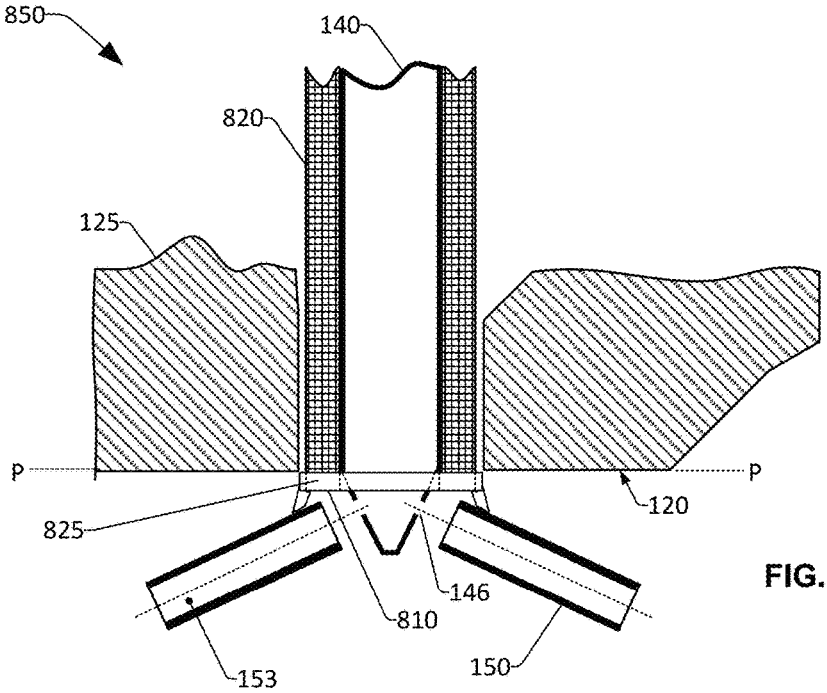
FIG. 8C is a schematic of a duct assembly attached to a fuel injector assembly.

In another embodiment, the injector tip can already be located at the flame deck and the duct(s) can be subsequently attached to the injector tip. As shown in FIGS. 8A and 8B, configuration 800, a locator ring 810 has a plurality of ducts 150 attached thereto. The locator ring 810 can include a means for attaching the locator ring 810; for example, an inner surface 815 of the locator ring 810 can be threaded, with the ducts 150 respectively attached by connectors 817. As shown in FIG. 8C, configuration 850, the locator ring 810 and ducts 150 can be assembled in combination with an injector 140. A sleeve 820, or similar structure, having the injector 140 incorporated therein, can further comprise an attachment means which compliments the attachment mechanism of the locator ring 810. For example, the sleeve 820 can include a threaded end 825 onto which the locator ring 810 can be threaded, wherein the respective ducts 150 can be located with respect to the respective openings 146 of the injector 140 to enable passage of a jet of fuel (e.g., jet of fuel 185) through the bore 153.

It is to be appreciated that the number of ducts 150 to be arranged around an injector tip 145 can be of any desired number, N (e.g., in accord with a number of openings 146 in a tip 145), where N is a positive integer. Hence, while FIG. 2 illustrates a configuration 200 comprising six ducts 150, FIGS. 8A and 8B illustrate a configuration 800 comprising three ducts 150, which are positioned relative to three openings 146 at the injector tip 145.

Figure 9A:
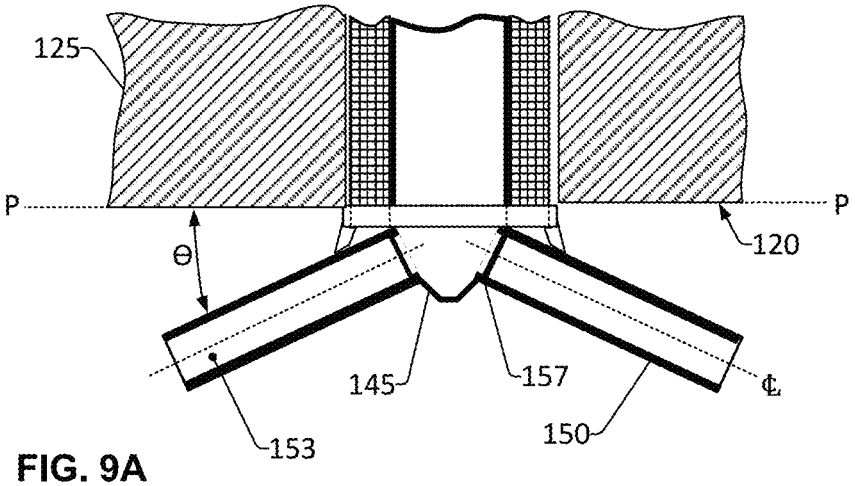
FIGS. 9A and 9B illustrate utilizing a duct to guide formation of an opening in a tip of a fuel injector.
Figure 9B:
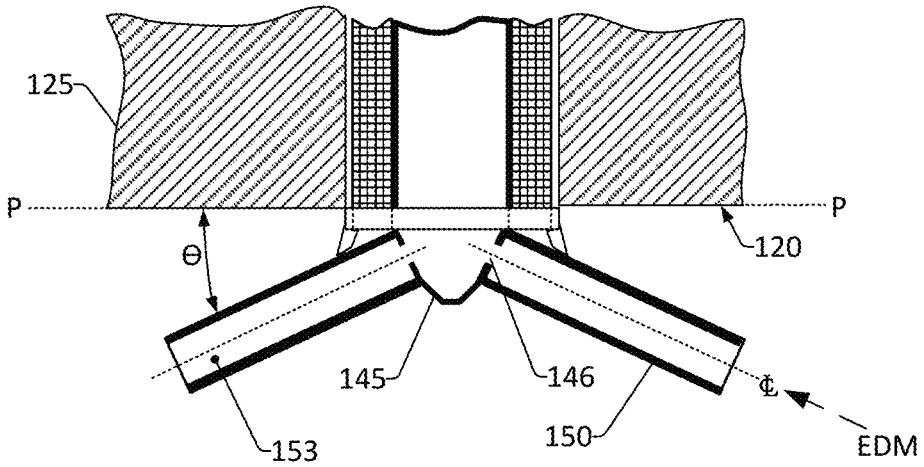

In an aspect, to maximize mixing of fuel and charge-gas in a duct bore it may be beneficial to have the direction of emission of the fuel from an opening in a fuel injector to be accurately co-aligned with the centerline of the bore. To achieve such accurate co-alignment, a bore can be utilized to aid formation of an opening. Such an approach is shown in FIGS. 9A and 9B. As illustrated in FIG. 9A, a duct 150 is positioned (e.g., as described with reference to FIGS. 7A, 7B, 8A, 8B, 8C) such that a first end 157 of the duct 150 abuts (e.g., there is no gap, G) an injector tip 145. The duct 150 is aligned at a desired angle θ° with reference to a plane P-P of a flame deck surface 120 and a desired centerline of travel, ℄, along which a jet of fuel (e.g., fuel 185, 685) will travel.

With the duct 150 positioned as desired, an opening 146 can be formed at the tip 145. In an embodiment, the opening 146 can be formed by electrical discharge machining (EDM), however, it is to be appreciated that any suitable fabrication technology can be utilized to form the opening 146. As shown, the duct 150 can be utilized to enable the EDM operation to be performed at desired angle, e.g., the duct 150 can be utilized to guide a tool piece (e.g., an EDM electrode) at an angle to enable formation of the opening 146 having an alignment to enable the jet of fuel to flow in the direction of the centerline of travel, ℄. It is to be appreciated that while FIGS. 9A and 9B show duct 150 abutting the injector tip 145, and further, having no openings along the length of the duct 150, other arrangements (e.g., any of the various configurations shown in FIGS. 1-8C) can be utilized. For example, the first end 157 of the duct 150 can be positioned proximate to the injector tip 145, e.g., with a gap G therebetween. In a further example, the duct 150 can include one or more holes along its length (e.g., holes $H_1$-$H_n$). In another example, the duct(s) 150 can be attached proximate to the injector tip 145 per either of configurations 700 or 850.

The duct(s) 150 can be formed from any material suitable for application in a combustion chamber, e.g., a metallic-containing material such as steel, INCONEL, HASTELLOY, etc., a ceramic-containing material, etc.

It is to be appreciated that the various embodiments presented herein are applicable to any type of fuel and an oxidizer (e.g., oxygen), where such fuels can include diesel, jet fuel, gasoline, crude or refined petroleum, petroleum distillates, hydrocarbons (e.g., normal, branched, or cyclic alkanes, aromatics), oxygenates (e.g., alcohols, esters, ethers, ketones), compressed natural gas, liquefied petroleum gas, biofuel, biodiesel, bioethanol, synthetic fuel, hydrogen, ammonia, etc., or mixtures thereof.

Further, the various embodiments presented herein have been described with reference to a compression-ignition engine (e.g., a diesel engine), however, the embodiments are applicable to any combustion technology such as a direct injection engine, other compression-ignition engines, a spark ignition engine, a gas turbine engine, an industrial boiler, any combustion driven system, etc.

Furthermore, as well as reducing the generation of soot, the various embodiments presented herein can also lower the emissions of other undesired combustion products. For example, production of nitric oxide (NO) and/or other compounds comprising nitrogen and oxygen can be lowered by utilizing a sufficiently fuel-lean mixture (e.g., at region 187 of jet 185). Also, unburned hydrocarbon (HC) and carbon monoxide (CO) emissions can be lowered if the correct mixture is created at the exit of the bore of a duct (e.g., bore 153 of duct 150) during combustion.

FIGS. 10-13 illustrate exemplary methodologies relating to forming a locally premixed mixture with a lower peak fuel to charge-gas ratio to minimize generation of soot and other undesirable emissions formed during combustion. While the methodologies are shown and described as being a series of acts that are performed in a sequence, it is to be understood and appreciated that the methodologies are not limited by the order of the sequence. For example, some acts can occur in a different order than what is described herein. In addition, an act can occur concurrently with another act. Further, in some instances, not all acts may be required to implement the methodologies described herein.

Figure 10:
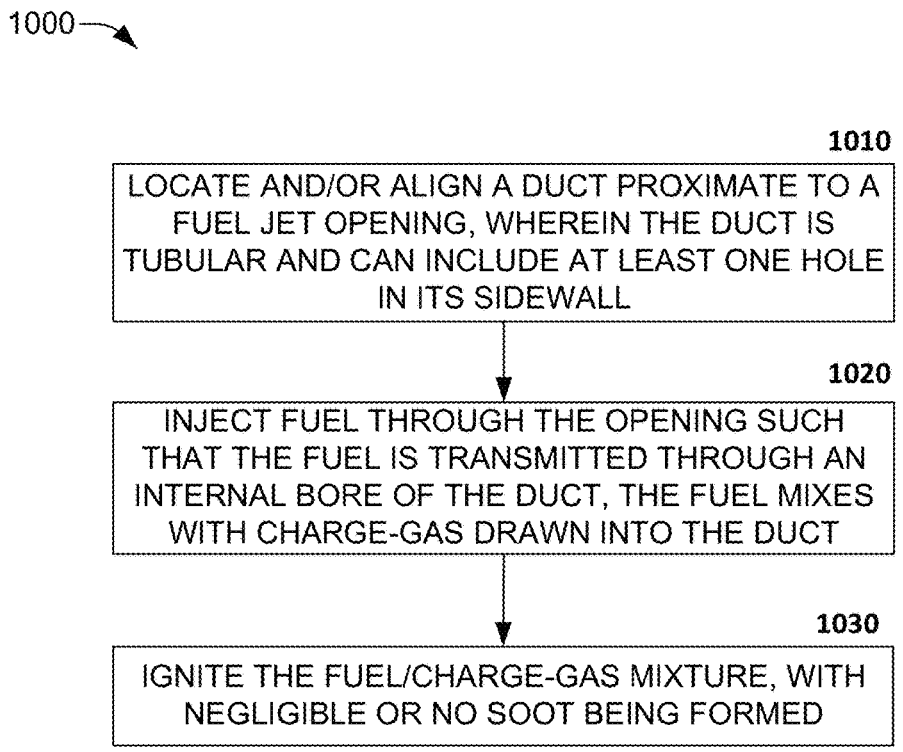
FIG. 10 is a flow diagram illustrating an exemplary methodology for creating a locally premixed mixture with a lower peak fuel to charge-gas ratio for ignition in a combustion chamber.

FIG. 10 illustrates a methodology 1000 for increasing mixing of a fuel prior to combustion. At 1010, a duct is located and/or aligned proximate to an orifice in a tip of a fuel injector. The duct can be a hollow tube, with an internal bore formed by an external wall. As previously described, by directing fuel through the internal bore of the duct, charge-gas is drawn into the duct with turbulent mixing occurring to cause generation of a locally premixed mixture with a lower peak fuel to charge-gas ratio exiting the duct. As further mentioned above, a number of holes can be formed in the external wall to facilitate drawing in further charge-gas from the combustion chamber to facilitate formation of a locally premixed mixture with a lower peak fuel to charge-gas ratio.

At 1020, fuel can be injected by the fuel injector, with the fuel passing through the orifice and into the bore of the duct. Passage of the fuel through the duct causes the fuel to mix with charge-gas drawn into the bore to enable the level of mixing to form the desired locally premixed mixture with a lower peak fuel to charge-gas ratio.

At 1030, the locally premixed mixture with a lower peak fuel to charge-gas ratio exiting the duct can undergo ignition as a function of operation of the combustion engine. Ignition of the locally premixed mixture results in negligible or no soot being formed, as compared with the larger quantities of undesirable emissions being formed from combustion of a "too-rich" mixture utilized in a conventional combustion engine or device.

Figure 11:
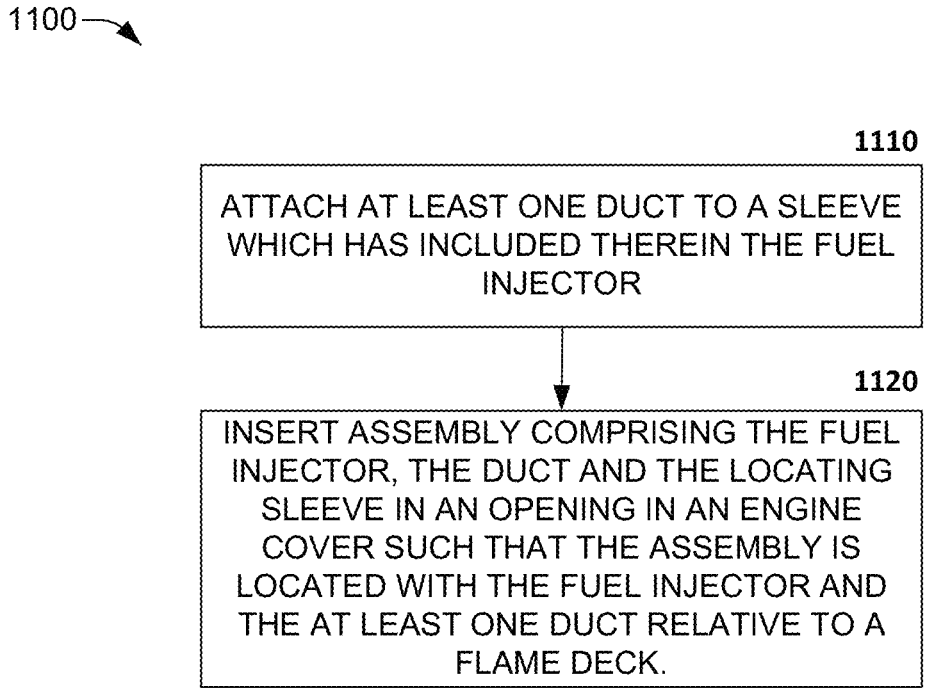
FIG. 11 is a flow diagram illustrating an exemplary methodology for locating an assembly comprising a fuel injector and at least one duct in a combustion chamber.

FIG. 11 illustrates a methodology 1100 for locating at least one duct at a fuel injector for incorporation into a combustion chamber. At 1110, at least one duct can be located proximate to an opening at a tip of a fuel injector. In an embodiment, the fuel injector can be placed in a sleeve to form an assembly such that a tip of a fuel injector protrudes from a first end of the sleeve. The at least one duct can be attached to the first end of the sleeve such that the at least one duct is aligned so that when a jet of fuel passes through a respective opening in the fuel injector, the jet of fuel passes through a bore in the duct. The at least one duct can be attached to the end of the first sleeve by any suitable technique, e.g., welding, mechanical attachment, etc.

At 1120, the assembly comprising the fuel injector, sleeve, and at least one duct can be placed in an opening in the cylinder head to enable the tip of the fuel injector and the at least one duct to be positioned, as desired, in relation to a plane P-P of a flame deck surface of a cylinder head, which further forms a portion of a combustion chamber.

Figure 12:
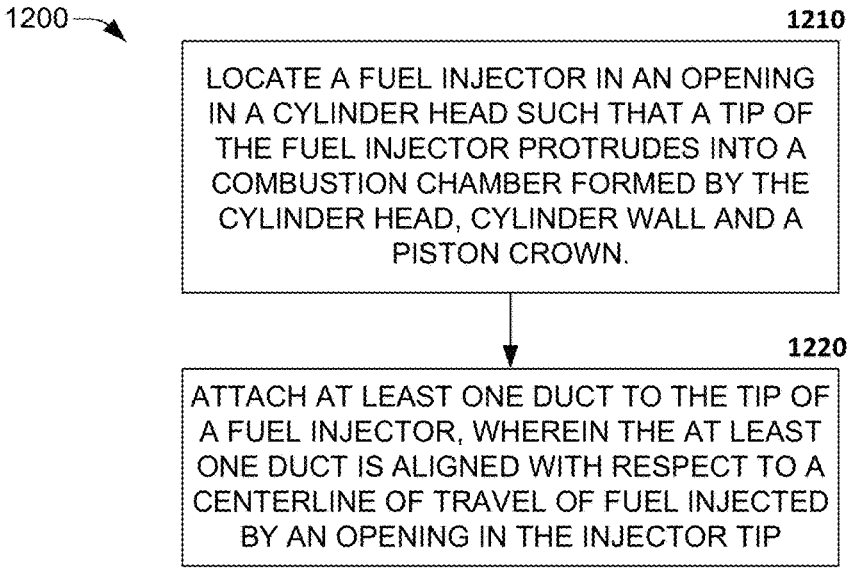
FIG. 12 is a flow diagram illustrating an exemplary methodology for locating at least one duct at a fuel injector in a combustion chamber.

FIG. 12 illustrates a methodology 1200 for locating at least one duct on a fuel injector incorporated into a combustion chamber. At 1210, a fuel injector can be placed in an opening in a cylinder head to enable a tip of the fuel injector to be positioned, as desired, in relation to a plane P-P of a flame deck surface of the cylinder head. The cylinder head, in combination with a piston crown and a wall of a cylinder bore, forms a combustion chamber.

At 1220, at least one duct can be attached to, or proximate to, the tip of the fuel injector such that the at least one duct can be located and/or aligned with respect to a direction of travel of fuel injected from each opening in the tip of the fuel injector with respect to each aligned duct.

Figure 13:
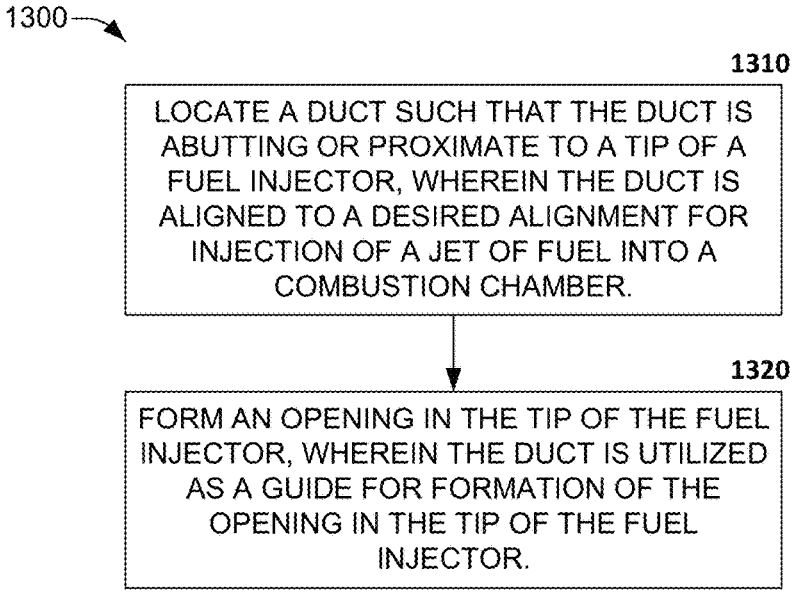
FIG. 13 is a flow diagram illustrating an exemplary methodology for utilizing a duct to guide formation of an opening in a tip.

FIG. 13 illustrates a methodology 1300 for utilizing a duct to guide formation of an opening in a tip of a fuel injector. At 1310, a duct is located at a tip of a fuel injector, wherein the duct can be positioned to abut the tip, or positioned with a gap G between a first (proximate) end of the duct. The duct can be aligned in accordance with a direction for which fuel is to be ejected from the fuel injector into a combustion chamber, e.g., the duct is aligned at an angle of θ° with reference to a plane P-P of a flame deck surface of the combustion chamber.

At 1320, an opening can be formed in the tip of the fuel injector. As previously described, the duct can be utilized to guide formation of the opening. For example, if the opening is to be formed by EDM, the bore of the duct can be utilized to guide an EDM electrode to a point on the tip of the fuel injector at which the opening is to be formed. Formation of the opening can subsequently occur per standard EDM procedure(s). Accordingly, the opening is formed at a desired location, e.g., centrally placed relative to the center of a circle forming a profile of the bore of the duct. Also, the walls of the opening can be aligned, e.g., parallel to the centerline ℄, to enable the jet of fuel being injected along the bore of the duct to be located centrally within the bore to maximize mixing between the fuel and the charge-gas drawn in from the combustion chamber.

Experiments were conducted relating to measurement of soot incandescence, which is indicative of whether LLFC was achieved when ducts were employed to inject fuel into a combustion chamber. In the experiments, LLFC was achieved, e.g., chemical reactions that did not form soot were sustained throughout the combustion event. OH* chemiluminescence was utilized to measure a lift-off length of a flame (e.g., axial distance between a fuel injector opening (orifice) and an autoignition zone). OH* is created when high-temperature chemical reactions are occurring inside an engine, and its most upstream location indicates the axial distance from the injector to where the fuel starts to burn, e.g., the lift-off length.

Conditions during the experiments are presented in Table 1.

TABLE 1

Operating conditions of a combustion chamber

| Ambient Temp. | Ambient Pressure | Ambient Gas Density | Ambient Oxygen Mole Fract. | Tip Opening Diameter | Fuel Injection Pressure | Fuel |
|---|---|---|---|---|---|---|
| 950 K | 6.0 MPa | 22.8 kg/m$^3$ | 21% | 0.090 mm | 150 MPa | n-dodecane |

A baseline freely propagating jet ("free-jet") flame exhibiting high soot incandescence signal saturation was observed, indicating that a significant amount of soot was produced without a duct in position. Next, the combustion of ducted jets was studied. A plurality of duct diameters and duct lengths were tested, including duct inside diameters of about 3 mm, about 5 mm, and about 7 mm, and duct lengths of about 7 mm, about 14 mm, and about 21 mm.

Such a ducted jet experiment was subsequently conducted, using identical imaging conditions and similar operating conditions as those referenced above for the free jet, where a 3 mm inside diameter×14 mm long untapered steel duct was positioned about 2 mm downstream (e.g., gap G=about 2 mm) from the injector. The soot incandescence signal exhibited almost no saturation, which indicates that minimal, if any, soot was produced. The post-duct flame did not spread out as wide as the free-jet flame in the baseline experiment, as it moved axially across the combustion chamber. The combustion flame centered about the centerline, ℄, resulted from a combination of the mixing caused by the duct (as previously described), and further as a function of heat transfer to the duct. The duct was operating at a temperature lower than the ambient conditions in the combustion chamber (e.g., 950 K), and accordingly, the duct allowed the injected fuel to travel in a lower temperature environment (e.g., within the bore of the duct) than would be experienced in a free jet flame.

A degree of turbulence generated during flow of the fuel through the duct was computed by determining a Reynolds number (Re) for conditions within the bore of the duct. Per Eqn. 1:

$$\mathrm{Re} = \frac{\rho V L}{\mu}, \qquad \text{Eqn. 1}$$

where ρ is the ambient density, V is velocity, L is the duct diameter, and μ is the dynamic viscosity. The velocity V was calculated per Eqn. 2:

$$V = \sqrt{\frac{2(p_{inj} - p_{amb})}{\rho_f}} \qquad \text{Eqn. 2}$$

where $p_{inj}$ is the fuel-injection pressure, $p_{amb}$ is the ambient pressure, and $\rho_f$ is the density of the fuel. Application of the operating conditions to Eqns. 1 and 2, generated Reynolds numbers of at least $1\times10^4$, indicating that turbulent conditions exist within the duct.

As previously mentioned, turbulent flow of a jet of fuel 185 through a duct 150 causes the jet of fuel 185 to mix with charge-gas that was drawn in from the outside of the duct 150 (e.g., through a gap G, and/or holes $H_1$-$H_n$), e.g., as a result of low local pressures in the vicinity of the duct entrance that are established by the high velocity of the injected jet of fuel 185. The turbulent mixing rate established within the duct 150 can be considered to be a function of the velocity gradients within the duct, which will be roughly proportional to the centerline fluid velocity at a given axial position divided by the duct diameter at the given axial position.

What has been described above includes examples of one or more embodiments. It is, of course, not possible to describe every conceivable modification and alteration of the above structures or methodologies for purposes of describing the aforementioned aspects, but one of ordinary skill in the art can recognize that many further modifications and permutations of various aspects are possible. Accordingly, the described aspects are intended to embrace all such alterations, modifications, and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A fuel injection system, comprising:

a fuel injector comprising a plurality of openings, wherein a fuel is injected through the openings into a combustion chamber of an engine; and a plurality of ducts located in the combustion chamber, each duct formed from a hollow tube, wherein each duct is aligned with a respective opening in the openings such that the fuel exiting the openings of the fuel injector is injected through the hollow tubes and into the combustion chamber, wherein passage of the fuel through the hollow tubes causes charge-gas present in the combustion chamber to be drawn into the hollow tubes thereby mixing the injected fuel with the charge-gas.

2. The fuel injection system of claim 1, each of the openings has a diameter, each hollow tube comprises an internal diameter, wherein the internal diameter of each hollow tube is between about 5 to about 50 times the diameter.

3. The fuel injection system of claim 2, wherein each duct has a length of between about 30 to about 300 times the diameter.

4. The fuel injection system of claim 2, wherein each duct comprises a first end and a second end, the first end of each duct is located most proximal to a respective opening of the fuel injector with a gap between the first end of the duct and the respective opening having a distance of up to about 100 times the diameter.

5. The fuel injection system of claim 1, wherein each duct is formed from a high temperature resistant material comprising at least one of a metallic material or a ceramic material.

6. The fuel injection system of claim 1, wherein each tube comprises a side wall, and at least one side wall of at least one tube in the tubes comprises an aperture that extends through the side wall, wherein charge-gas enters into the at least one tube through the aperture.

7. The fuel injection system of claim 1, each tube being cylindrical.

8. The fuel injection system of claim 1, wherein the combustion chamber is formed from a cylinder bore formed in an engine block, wherein a flame deck surface is disposed at one end of the cylinder bore, and a piston crown surface of a piston is disposed at another end of the cylinder bore, wherein the piston crown surface is connected to a rotatable crankshaft and configured to reciprocate within the cylinder bore, the piston crown surface faces the flame deck surface.

9. A method for mixing a fuel with a charge-gas in a combustion chamber, comprising:

injecting fuel through a plurality of openings in a fuel injector, the openings located in the combustion chamber; and mixing the injected fuel with the charge-gas in a plurality of ducts located within the combustion chamber, wherein each of the ducts comprises a hollow tube and is aligned with a respective opening in the openings such that the injected fuel travels through the hollow tubes and into the combustion chamber, the passage of the fuel through the hollow tubes causing turbulent flow of the fuel within the hollow tubes, thereby causing charge-gas present in the combustion chamber to be drawn into the hollow tubes and mixing the injected fuel with the charge-gas.

10. The method of claim 9, wherein each of the ducts comprises a first end and a second end, the first end of each duct is located proximal to the respective opening with which the duct is aligned, with a gap between the first end of the duct and the respective opening having a distance of up to about 100 times a diameter of the respective opening.

11. The method of claim 9, wherein the hollow tubes comprise respective sidewalls, and further wherein at least one sidewall of at least one hollow tube has an aperture therethrough, the aperture enabling ingress of charge-gas into the at least one hollow tube.

12. The method of claim 9, wherein the ducts are formed from a high temperature resistant material comprising at least one of a metallic material or a ceramic material.

13. The method of claim 9, wherein the combustion chamber is further formed from a cylinder bore formed in an engine block, wherein a flame deck surface of the combustion chamber is disposed at one end of the cylinder bore, and a piston crown surface of a piston is disposed at another end of the cylinder bore, wherein the piston is connected to a rotatable crankshaft and configured to reciprocate within the cylinder bore, the piston crown surface faces the flame deck surface.

14. A fuel injection system, comprising:

a fuel injector comprising a first opening and a second opening, wherein a first jet of fuel is injected through the first opening into a combustion chamber, and a second jet of fuel is injected through the second opening into the combustion chamber;

a first duct positioned in the combustion chamber and formed from a first hollow tube, wherein the first duct is aligned such that the first jet of fuel exiting the first opening is injected through the first hollow tube and into the combustion chamber such that the passage of the fuel through the first hollow tube causes charge-gas present in the combustion chamber to be drawn in the first hollow tube thereby mixing the injected fuel with the charge-gas; and a second duct positioned in the combustion chamber and formed from a second hollow tube, wherein the second duct is aligned such that the second jet of fuel exiting the second opening is injected through the second hollow tube and into the combustion chamber such that the passage of the fuel through the second hollow tube causes charge-gas present in the combustion chamber to be drawn in the second hollow tube thereby mixing the injected fuel with the charge-gas.

15. The fuel injection system of claim 14, wherein the first hollow tube comprises a first side wall, the first side wall comprises a first aperture therethrough, and wherein the second hollow tube comprises a second side wall, the second side wall comprises a second aperture therethrough.

16. The fuel injection system of claim 6, wherein each side wall of each tube comprises a plurality of apertures that extend through the side walls of the tubes.

* * * * *